US005786830A

United States Patent [19]

Su et al.

[11] Patent Number: 5,786,830

[45] Date of Patent: Jul. 28, 1998

[54] ADAPTIVE WIPING SYSTEM FOR INKJET PRINTHEADS

[75] Inventors: Wen-Li Su, Vancouver, Wash.; Kris M. English, Portland, Oreg.

[73] Assignee: Hewlett-Packard Company, Palo Alto, Calif.

[21] Appl. No.: 608,787

[22] Filed: Feb. 29, 1996

Related U.S. Application Data

[63] Continuation-in-part of Ser. No. 558,561, Oct. 31, 1995.

[51] Int. Cl.[6] ..... B41J 2/165

[52] U.S. Cl. ..... 347/33

[58] Field of Search ..... 347/20, 22, 33

[56] References Cited

U.S. PATENT DOCUMENTS 4,829,318 5/1989 Racicot et al. ..... 347/33

5,184,147 2/1993 MacLane et al. ..... 347/30

5,396,271 3/1995 Premnath ..... 347/33

5,559,539 9/1996 Vo et al. ..... 347/33

5,570,117 10/1996 Karambelas et al. ..... 347/33

*Primary Examiner*—Adolf Berhane

*Attorney, Agent, or Firm*—Flory L. Martin

[57] ABSTRACT

An adaptive wiping method of cleaning an inkjet printhead in an inkjet printing mechanism cleans two or more diverse printheads that have different wiping needs, such as those dispensing different types of ink. Each printhead has an associated wiper that is mounted on a single service station sled for relative movement with respect to the printheads to achieve wiping contact. By offsetting the wipers, during one portion of the wiping stroke, at least one of the printheads may be wiped while at least one other printhead is not being wiped. This adaptive wiping system allows the printheads to be individually wiped at different speeds, which allows the system to be tailored to meet the diverse servicing needs of different inkjet cartridges, for instance, those containing different ink formulations.

21 Claims, 5 Drawing Sheets

ADAPTIVE WIPING SYSTEM FOR INKJET PRINTHEADS

RELATED APPLICATIONS

This application is a continuation-in-part application of the pending U.S. patent application Ser. No. 08/558,561, filed on Oct. 31, 1995, which has at least one inventor in common herewith.

FIELD OF THE INVENTION

The present invention relates generally to inkjet printing mechanisms having more than one inkjet printhead, and more particularly to an adaptive wiping system that adapts its cleaning routine to the different needs of diverse inkjet printheads installed side-by-side, such as those dispensing different types of ink.

BACKGROUND OF THE INVENTION

Inkjet printing mechanisms use pens which shoot drops of liquid colorant, referred to generally herein as "ink," onto a page. Each pen has a printhead with an orifice plate that is formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

Indeed, keeping the nozzle face plate clean for cartridges using pigment based inks has proven quite challenging. In the past, multiple inkjet printheads were wiped simultaneously, all at the same speed, which was fine when all the cartridges contained the same type (albeit different colors) of ink. However, these pigment based inks are less viscous than the dye based inks, so the pigment based inks require a slower wiping speed than that previously needed for dye based inks. Yet, there is an lower limit to the wiping speed because too slow a wipe wicks excessive amounts of ink from the dye based pens. This excess dye based ink eventually builds-up a residue on the wiper, leading to less effective wiping in the future, as well as other problems. For instance, other problems caused by this residue on the wiper include puddling of ink on the orifice plate, which can lead to undesirable color mixing or misdirected nozzles. Another significant problem caused by ink residue on the wiper is the excessive ink build-up on the printhead, which may also lead to this cross-contamination and color mixing between the different colors. Moreover, excess residue around the wipers may lead to ink build-up around the service station, which could contaminate the caps. Printhead cap contamination may lead to shorter cartridge life because ineffective capping may induce failures in the cartridge.

Actually, a scrubbing type of wiping routine is preferred to clean the tar-like pigment ink residue from the printheads. If a faster wipe was used to accommodate the dye based inks, the wiper for the pigment based ink is prevented from making full contact with the residue. Instead, the wiper skips over bumps formed from the tar-like pigment based ink residue in a jerking or stuttering type of motion, which failed to remove the residue from the printhead. In some cases, during this faster wiping stroke the wiper for the pigment based ink flexed and wiped over the tar-like residue, which smeared the ink over the orifice plate rather than removing it. Thus, any compromise in attempting to accommodate the wiping needs of one pen was at the sacrifice of meeting the needs of the other type of pen.

SUMMARY OF THE INVENTION

According to one aspect of the present invention, a method is provided for cleaning first and second orifice plates of respective first and second inkjet printheads in an inkjet printing mechanism. The method includes the step of first wiping the first orifice plate with a first wiper at a first speed. In a second wiping step, the second orifice plate is wiped with a second wiper at a second speed different from the first speed.

According to another aspect of the present invention, a wiping apparatus is provided for cleaning first and second orifice plates of respective first and second inkjet printheads installed in an inkjet printing mechanism having a frame. The wiping apparatus includes first and second upright wiper blades, as well as a support structure that joins the first and second wiper blades to the printing mechanism frame for movement between a rest position and a servicing position. The first wiper blade is supported by the support structure so when in the servicing position, the first wiper blade contacts the first orifice plate for wiping through a first relative movement of the first printhead and the first wiper blade, without the second wiper blade contacting the second orifice plate. The second wiper blade is supported by the support structure so when in the servicing position, the second wiper blade contacts the second orifice plate for wiping through a second relative movement of the second printhead and second wiper blade, without the first wiper blade contacting the first orifice plate.

According to further aspect of the present invention, a method is provided for cleaning first and second orifice plates of respective first and second inkjet printheads installed in an inkjet printing mechanism. In a first positioning step, the first orifice plate and a first wiper blade are positioned into mutual engagement. After the first positioning step, first wiping the first orifice plate with the first wiper blade through relative movement of the first printhead and the first wiper blade. In a second positioning step, the second orifice plate and a second wiper blade are positioned into mutual engagement. After the second positioning step, in a second wiping step, the second orifice plate is wiped with the second wiper blade through relative movement of the second printhead and the second wiper blade. During the first wiping step, the method includes the step of refraining from contacting the second orifice plate with the second wiper blade. During the second wiping step, the method includes the step of refraining from contacting the first orifice plate with the first wiper blade.

An overall goal of the present invention is to provide an inkjet printing mechanism which prints sharp vivid images, particularly when using different printheads that have different wiping needs, such as one dispensing a fast drying pigment based ink, and one dispensing a fast drying dye based ink.

Another goal of the present invention is to provide a robust wiping system capable of reliably cleaning the nozzle face plates of inkjet printheads, whether containing a dye-based ink or a pigment-based ink.

DETAILED DESCRIPTION OF THE PREFERRED EMBODIMENTS

Figure 1:
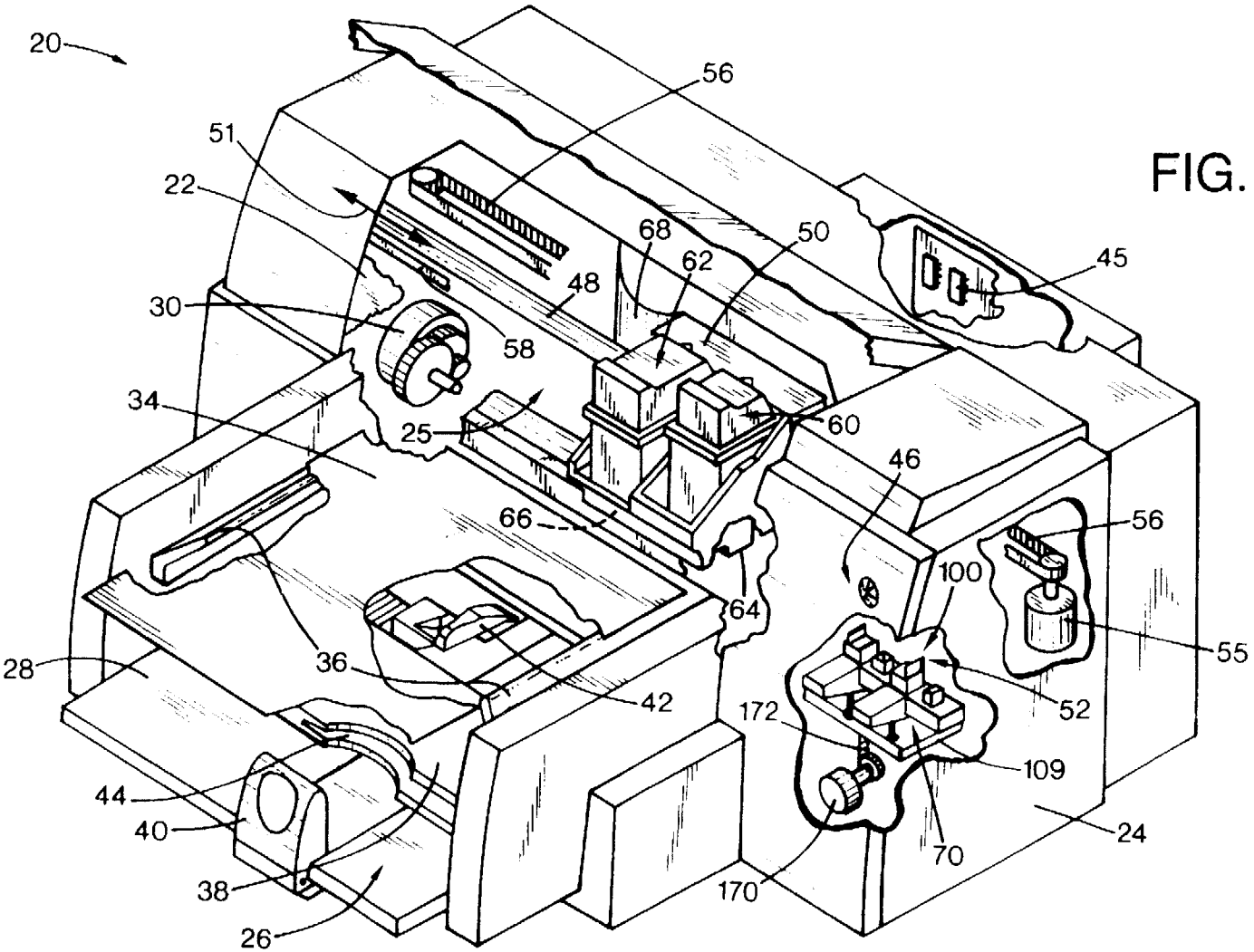
FIG. 1 is a fragmented, partially schematic, perspective view of one form of an inkjet printing mechanism using an adaptive wiping system of the present invention for servicing two diverse inkjet printheads having different servicing needs.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional paper drive rollers (not shown), driven by a stepper motor and drive gear assembly 30, may be used to move the print media from tray 28 into the print zone 25, as shown for sheet 34, for printing. After printing, the motor 30 drives the printed sheet 34 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and a sliding envelope feed plate 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support a dual inkjet pen carriage system 50 for travel back and forth across the print zone 25 along a scanning axis 51. The carriage 50 is also propelled along guide rod 48 into a servicing region, as indicated generally by arrow 52, located within the interior of the housing 24. A carriage drive gear and DC motor assembly 55 is coupled to drive an endless belt 56. The motor 55 operates in response to control signals received from the controller 45. The belt 56 may be secured in a conventional manner to the carriage 50 to incrementally advance the carriage along guide rod 48 in response to rotation of motor 55.

To provide carriage positional feedback information to printer controller 45, an encoder strip 58 extends along the length of the print zone 25 and over the service station area 52. A conventional optical encoder reader may also be mounted on the back surface of printhead carriage 50 to read positional information provided by the encoder strip 58. The manner of attaching the belt 56 to the carriage, as well as the manner providing positional feedback information via the encoder strip reader, may be accomplished in a variety of different ways known to those skilled in the art.

In the print zone 25, the media sheet 34 receives ink from an inkjet cartridge, such as a black ink cartridge 60 and/or a color ink cartridge 62. The cartridges 60 and 62 are also often called "pens" by those in the art. The illustrated color pen 62 is a tri-color pen, although in some embodiments, a set of discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as paraffin based inks, as well as hybrid or composite inks having both dye and pigment characteristics.

Figure 4:
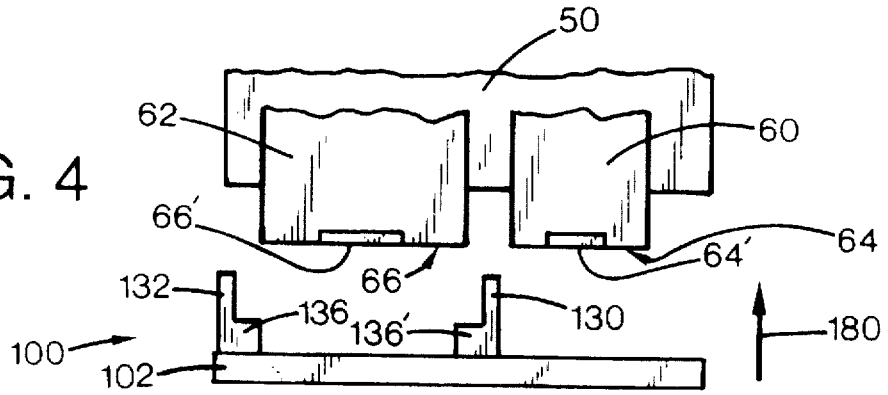
FIGS. 4–9 are schematic front elevational views of a portion of the adaptive wiping system of FIG. 1, showing different stages of a bi-directional wiping sequence that meets the different wiping needs of the two diverse inkjet printheads.

The illustrated pens 60, 62 each include reservoirs for storing a supply of ink therein. The black pen 60 has a printhead 64 which includes an orifice plate 64', while the color pen 62 has a printhead 66 which includes an orifice plate 66'. In FIG. 4 the orifice plates or nozzle plates 64', 66' are illustrated schematically as the small rectangles inset along the bottom of the cartridges 60, 62, respectively. Each orifice plate 64', 66' has a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a plurality of resistors which are associated with the nozzles. Upon energizing a selected resistor, a bubble of gas is formed ejecting a droplet of ink from the nozzle and onto a sheet of paper in the print zone 25 under the nozzle. The printhead resistors are selectively energized in response to firing command control signals delivered by a multi-conductor strip 68 from the controller 45 to the printhead carriage 50.

Adaptive Wiping System

Figure 2:
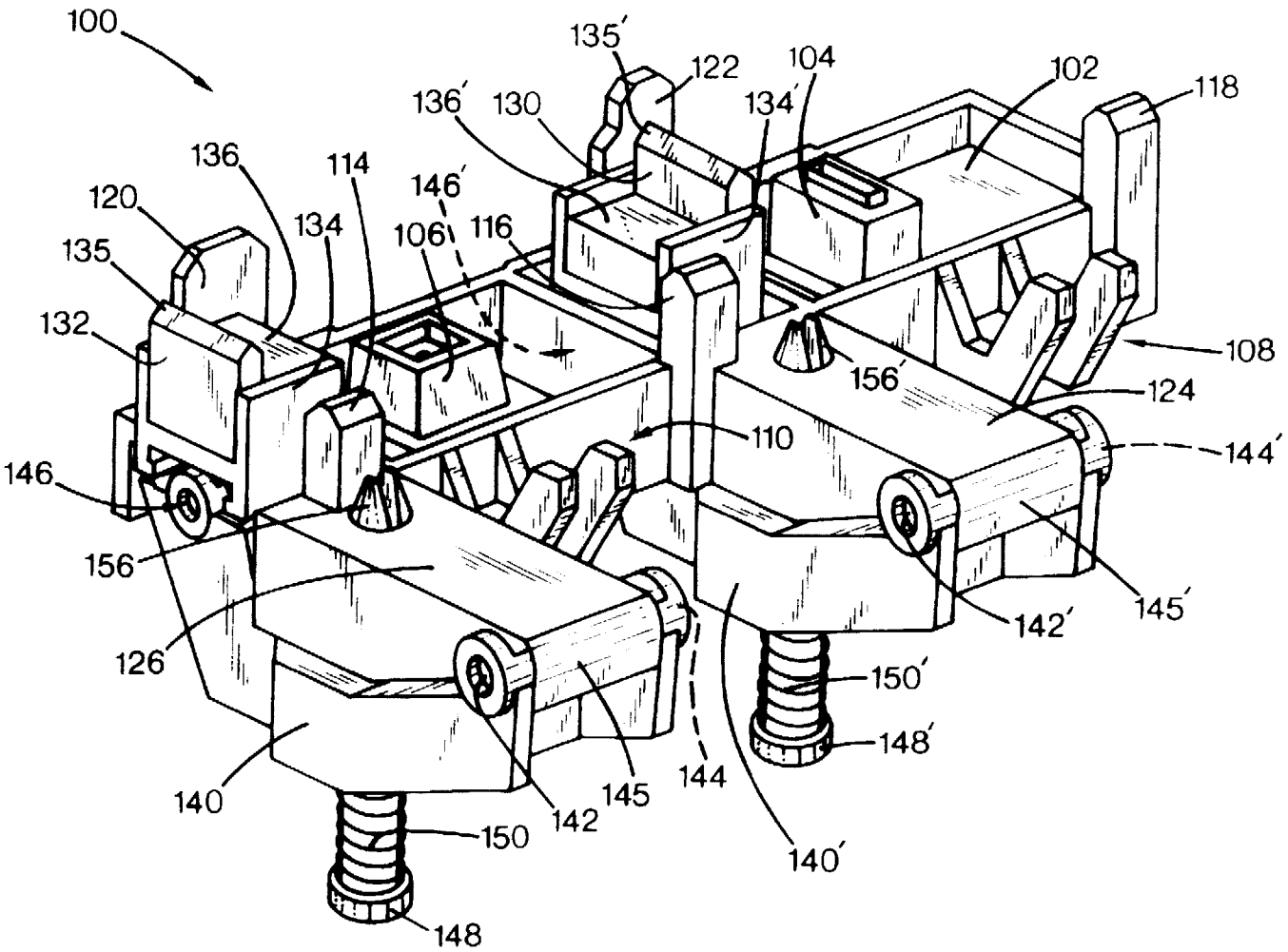
FIG. 2 is a perspective view of the main portion of the printhead service station of FIG. 1.
Figure 3:
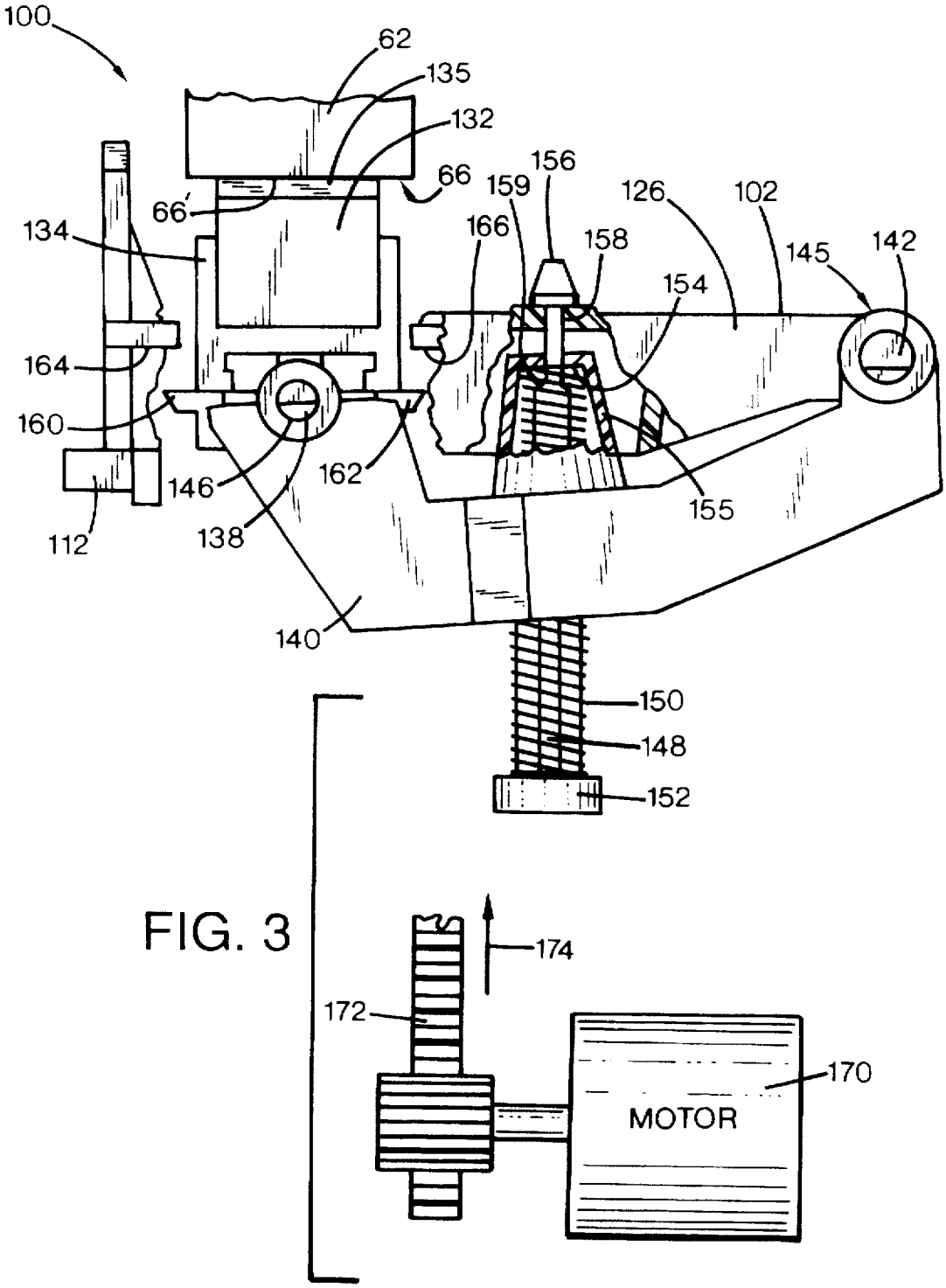
FIG. 3 is a partially fragmented, side elevational view of the adaptive wiper system of FIG. 1, shown wiping one inkjet printhead.

FIGS. 2 and 3 show one embodiment of a printhead service station 70 that resides within the servicing region 52 of the printer enclosure 24. The service station 70 includes an adaptive wiping or wiper system 100 constructed in accordance with the present invention for servicing the inkjet cartridges 60, 62. The wiper system 100 is illustrated as being an integral part of a pen capping and wiping system, including a servicing implement support member, such as a sled 102, that supports various servicing implements. The sled 102 supports a black printhead cap 104 and a color printhead cap 106, for substantially sealing the respective black and color printheads 64, 66 during periods of printing inactivity. The caps 104, 106 may be of any conventional design.

The sled 102 may be moved into various servicing positions using a variety of different elevating mechanisms known to those skilled in the art, several of which are discussed further below. To assist in coupling the sled 102 to a base unit 109 coupled to such an elevating mechanism (not shown), the sled includes two sets of mounting arms 108, 110 (FIG. 2), and a rear mounting member 112 (FIG. 3). To assist in aligning the servicing components with the cartridges 60, 62, the sled 102 includes three alignment members 114, 116 and 118 located toward the front of the printer 20, and two rear alignment members 120, 122 located toward the rear of the sled 102.

The sled 102 has two support arms 124, 126 which extend forwardly from the main body of the sled. The adaptive wiper system 100 includes a black wiper 130 and a color wiper 132 for wiping printheads 64, 66, respectively. The wipers 130, 132 are preferably of a resilient, non-abrasive, elastomeric material, such as nitrile rubber, or more preferably ethylene polypropylene diene monomer (EPDM), or other comparable materials known in the art. In a preferred embodiment, the durometer of the EPDM wiper material is selected between the range of 40–100, on the Shore A scale, with a more preferred range being between 85–95, with a preferred nominal value being about 90, plus or minus a standard tolerance, such as ±5. It is apparent that the wipers 130, 132 may be made of different materials, or of materials having different durometers. However, to simplify manufacturing procedures, and to reduce the number of different parts required to assemble the printer 20, preferably the wipers 130 and 132 are of the same material and construction. For the same reasons, the manner of attaching the wipers 130, 132 to the sled 102 is preferably also the same. Thus, in describing the illustrated embodiment of attaching the wipers 130 and 132 to the sled 102, the components will be described with respect to the color wiper 132, and with similar parts for the black wiper 130 which are visible in the drawings being indicated with the same item number primed (').

For example, item number 134 is a stem portion which receives wiper 132, whereas item number 134' will be used to indicate the stem which receives wiper 130.

Thus, the illustrated wipers 132, 130 each include an upright wiper blade portion 135, 135' which is integrally formed with a block mounting portion 136, 136'. Each wiper blade 135, 135' has two opposing sides which taper into a peaked wiping edge that engages the respective printheads 66, 64. The wiper blades 135, 135' and the block portions 136, 136' are seated within the stem portions 134, 134'. The wiper stem 134, 134' has a pair of pivot posts, such as pivot post 138 (FIG. 3) which is pivotally received by a distal end of a wiper support arm 140, 140'. The wiper arm 140 has a proximate end supported by a pair of pivot posts 142 and 144 which extend outwardly from each side of the support arm 126 for supporting the color wiper 132. The wiper arm 140' is similarly supported by a pair of pivot posts 142' and 144' which extend outwardly from each side of the support arm 124 for supporting the black wiper 130. The pivot posts 142, 144 and 142', 144' define what is referred to herein as an elbow joint 145, 145', whereas the pivot posts 138 define a wrist joint, such as joint 146. Thus, the combination of the elbow and wrist joints form a dual pivoting wiper support system.

To bias the wiper arm 140 toward the sled 102, the wiper system 100 includes a biasing element or member, here illustrated as a retainer 148, 148' and a compression coil spring 150, 150'. Preferably, spring 150, 150' is selected to have a preferred spring rate of 0.05–0.15 N/mm (Newtons per millimeter), or more preferably a spring rate of 0.05–0.10 N/mm, and a preferred force of 0.4–0.8N, or more preferably a force of 0.5–0.65N both at a compressed length of approximately 27 mm, and at a free length of approximately 36 mm. One end of spring 150, 150' is retained by a lip 152 at the base of retainer 148. FIG. 3 shows the other end of spring 150 is received within a pocket 154 defined by an upward protuberance 155 extending upwardly from arm 140. The spring retainer 148 has a distal end 156, 156' which extends through a hole 158 defined by and extending through the support arm 126. Preferably, this is a loose fit which allows the retainer 148 to toggle and rock in hole 158 as arm 140 pivots and during wiping.

To limit the downward motion of wipers 130, 132, the retainer 148, 148' has a shoulder portion 159 which engages the end of the pocket 154. Thus, downward motion of the wiper arm 140, 140' compresses the spring 150, 150' until the end of pocket 154 hits the retainer shoulder 159. Other biasing elements may also be used, for instance, a leaf spring (not shown) coupling the arm 140, 140' to the sled 102, or a torsional spring (not shown) located at the elbow joint 145, 145'. To limit the upward motion of the wipers 130, 132, the wiper stem 134, 134' includes a pair of prealignment features, such as projections, shelves or tabs 160, 162 which extend outwardly to engage a pair of engagement members, such as protuberances, abutments or stops 164, 166, respectively, extending from the sled 102. The wiper blades 130, 132 are advantageously held at an initial nominal position by engagement of the tabs 160, 162 with the respective stops 164, 166 before engaging the printheads 64, 66. This initial alignment advantageously minimizes wiper to printhead misalignment.

FIG. 3 shows the illustrated wiper system 100 raised to a servicing position, here, a wiping position, by a motor 170 and the elevation adjustment means provided by the rack and pinion gear 172, in the direction indicated by arrow 174. The sled 102 is coupled to the rack and pinion gear mechanism 172 by the base unit 109, shown schematically in FIG. 1. The gear mechanism 172 and base unit 109 may be constructed in any conventional manner to move the wipers 130, 132 into engagement with the respective printheads 64, 66, for instance, by using the mechanism shown in U.S. Pat. No. 5,155,497, assigned to the present assignee, Hewlett-Packard Company. Other mechanisms may also be used to move sled 102 into a wiping position, such as by moving the sled 102 laterally up a ramp (not shown) the concepts expressed in U.S. Pat. No. 5,440,331, also assigned to the present assignee, Hewlett-Packard Company.

Figure 5:
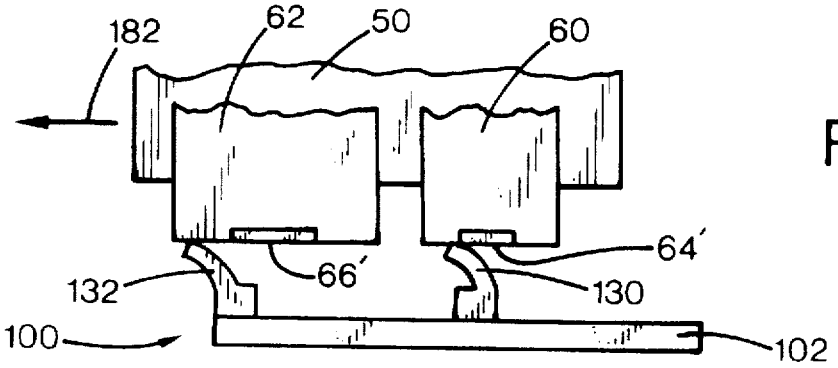

In the side elevational view of FIG. 3, the color wiper 132 is shown wiping the color printhead 66. At a similar elevation, it is apparent that the black wiper 130 may wipe the black printhead 64 in a similar manner. In FIG. 3, spring 150 is compressed to a nominal amount, although it is apparent that greater compressions may be experienced, until the end of the arm pocket 154 actually hits the retainer shoulder 159. Such an extreme compressed position may accommodate a very close printhead to sled spacing (high interference) when the wiper blade 135, 135' is engaged by the printhead 66, 64 (FIGS. 1 and 5). Other pen-to-sled spacings may be accommodated by the varying degrees of compression experienced by springs 150 and 150'.

If the face plate of the printhead 66, 64 is crooked with respect to sled 102, that is, tilted or offset from front to rear (perpendicular with the scanning axis 51) of a plane parallel with the sled, then flexure of the wrist joint 146 automatically aligns the peaked wiping edge of blade 135 parallel to the face plate. Preferably, the wiper blades 130, 132 are initially held at a nominal position by engagement of the tabs 160, 162 with the respective stops 164, 166 before contacting the printheads 64, 66. Then after engagement, the wrist joint 146, 146' flexes preferably about 1° either toward the front or back of the printer to accommodate any misalignment of the printhead with respect to sled 102. It is apparent that any given embodiment of this wiper system may be modified to accommodate other angles of printhead-to-sled misalignment, and the 1° value (as well as other component values given herein) is only given to describe the illustrated preferred embodiment. As the wiper blade 135, 135' moves across the printhead (either by moving the wiper, or as shown here, by moving the printhead), the wrist joint 146, 146' can flex to maintain contact across the entire width of the face plate.

By maintaining this dual pivoting action of joints 145, 145' and 146, 146' within a single plane (parallel with the sheet of paper in FIG. 3), the wiper blade 135, 135' remains in a substantially upright alignment for wiping the respective printheads 66, 64. During wiping, the contact angle remains the same, independent of the degree of interference of the wiper and printhead, regardless of whether it is a high interference (close spacing), a nominal interference (nominal spacing), or a low interference (larger printhead to sled spacing), where spring 150, 150' is only compressed minimally. Regardless of the degree of spacing between the printheads 64, 66 and sled 102, the illustrated wiping system 100 compensates for these variations, as well as for any lack of parallelism between the printheads and the wiper blade tips 135, 135'. Moreover, if the printhead also is canted from side-to-side (not parallel with the scanning axis 51), the adaptive wiping system 100 automatically accommodates for this circumstance by just changing the compression of the spring 150, 150' as the printhead 66, 64 is moved over the wiper 132, 130.

Advantageously, the wiper blades 135, 135' and the block portions 136, 136' are seated within the stem portion 134, 134' so the two block portions 136, 136' are inboard, facing one another, and the blades 135, 135' are located toward the outboard sides of the sled 102. The advantage realized by this unique configuration is the ability to wipe each printhead 64, 66 independently of the other one. That is, the spacing of the blades 135, 135' is staggered, here, wider than the relative side-to-side spacing of the printheads 64, 66, although in some embodiments, it is apparent that the blades may be spaced closer together than the printheads. Thus, one printhead may be wiped at one speed, while the other printhead may be wiped at another different speed. This advantageously allows the adaptive wiper system 100 to adapt to and conform with the diverse wiping needs of two very different printheads, here, the pigment based black ink printhead 64, and the dye based tri-color printhead 66.

In operation, during printing the sled 102 of the service station 70 is at a rest position, lowered away from the path of printhead travel. In this rest position, the spring 150, 150' preferably pre-loads the wiper arm 140, 140' to force the tabs 160, 162 of stems 134, 134' into contact with the sled stops 164, 166, respectively. To initiate servicing, the service station motor 170 (FIG. 1) and gear mechanism 172 cooperate to move the sled 102 toward the printheads, in the direction indicated by arrow 174. Upon engaging the wipers 130, 132 with the printheads 64, 66, the biasing springs 150, 150' are compressed as the arm 140, 140' rocks downward, pivoting at elbow joint 145, 145'. This downward pivoting at elbows 145, 145' allows the wiper stem 134, 134' to pivot at wrist joint 146, 146' to rock the edges of the wiper blades 135, 135' into full engagement with each printhead 64, 66, which accommodates for any angular wiper to printhead misalignment. Pivoting at the elbow joints 145, 145' compensates for printhead to sled spacing variations. These angular and spacing variations may be caused by part tolerance accumulations, or less than optimal pen seating in carriage 50.

During wiping the upright structure of blade 135, 135' remains at a substantially constant angle with respect to the printheads 64, 66. In practicality, there is very little bending of the blade 135, 135' with respect to the stem 134, 134' during wiping, due to the downward motion of arm 140, 140'. During wiping as shown in FIG. 3, the wiper load increases the force applied to the spring 150, 150' over the initial pre-load force used to bias the wiper into a seated position at rest as shown in FIG. 2. The spring 150, 150' pushes or urges the wiper blade 135, 135' into constant engagement with the printhead 66, 64 at a force which may be varied by selecting the spring with a particular rate and force. As mentioned above, offsetting the wiper blades 130, 132 advantageously allows each of the printheads 64, 66 to be wiped separately. Thus, the adaptive wiping system 100 may accommodate the different wiping needs of these two different pens. As discussed in the Background portion above, for the illustrated pigment based black ink cartridge 60 a slow, scrubbing type of wiping stroke is preferred. In contrast, the illustrated algea dye based color ink cartridge 62 needs a faster wiping stroke, here, about four times as fast as that preferred for the black pen 60. By offsetting the wiper blades 130, 132, only one of the wipers is in contact with its associated printhead orifice plate 64', 66' at any given time during the wiping stroke. Thus, while one wiper is actively wiping its associated printhead orifice plate (e.g., the black wiper 130 and orifice plate 64'), the other wiper is not in contact with its associated printhead orifice plate (e.g., the color wiper 132 and orifice plate 66').

FIGS. 4–9 schematically illustrate the operation of the adaptive wiping system 100 by simplifying the sled 102, carriage 50, cartridges 64, 66, and wipers 130 and 132. For instance, the wedge-shaped wiping edge 135, 135' of the wipers has been omitted in FIGS. 4–9 for simplicity, as well as to illustrate the concept that these principles may be implemented using other wiper blade designs. The wiping stroke starts in FIG. 4, with the carriage 50 positioning the pens 60, 62 over the service station sled 102. The sled is shown in the rest position, where the pens may pass freely over the wipers, for instance to move toward the printzone 25, or to move toward the caps 104, 106 for sealing during periods of inactivity. The wiping sequence begins when the service station motor 170 moves the sled upward, as indicated by arrow 180 into a wiping position at the elevation shown in FIGS. 5–9.

In FIG. 5, the carriage 50 has begun the relative movement of the printheads 64, 66 with respect to the wipers 130, 132 by moving the pens 60, 62 in a first direction indicated by arrow 182, here, to the left. In FIG. 5, the black wiper 130 is just beginning to wipe across the black orifice plate 64', while the color wiper 132 has not yet contacted the color orifice plate 66'. Recall that in the schematic views of FIGS. 4–9, the orifice plates 64', 66' are illustrated as the small rectangles inset along the bottom of the cartridges 60, 62, respectively. For the illustrated cartridges, preferably the black orifice plate 64', which dispenses a pigment based ink, is wiped at a slew speed (linear scanning speed of the carriage 50) of about 7.62 cm/sec. (centimeters per second) (3.0 inches per second).

Figure 6:
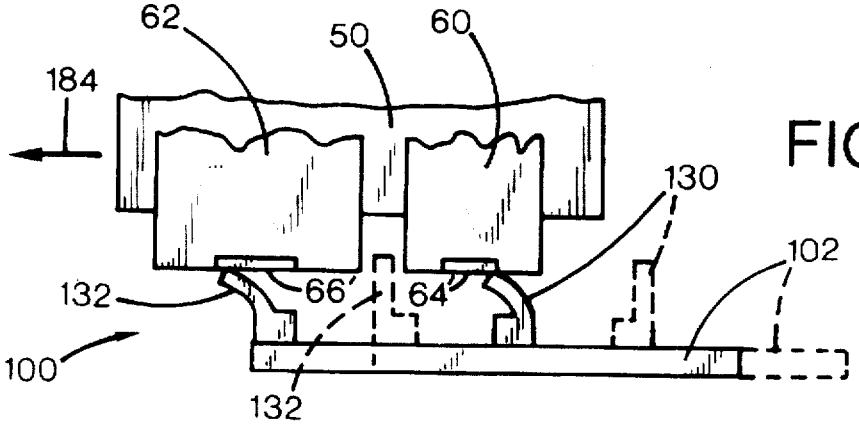

In FIG. 6, the black wiper 130 has finished wiping the black orifice plate 64', and the color wiper 132 has just begun to contact the color orifice plate 66', as shown in solid lines. Now the wiping speed is increased to accommodate the servicing needs of the color pen 60. For the illustrated color orifice plate 66', which ejects a dye based ink, the wiping speed is preferably around 30.48 cm/sec. (12.0 inches per second). The dashed lines in FIG. 6 show the relative positions of the wipers 130, 132 with respect to the pens 60, 62 at the completion of the first direction of travel (arrow 184) of the total wiping stroke, although it is apparent that the illustrated wipers do not move laterally. From the relative position of the wipers 130, 132 (dashed lines) and the pens 60, 62 shown in FIG. 6, the carriage 50 then reverses direction, as indicated by arrow 186 in FIG. 7, to perform a bi-directional wiping stroke.

Figure 7:
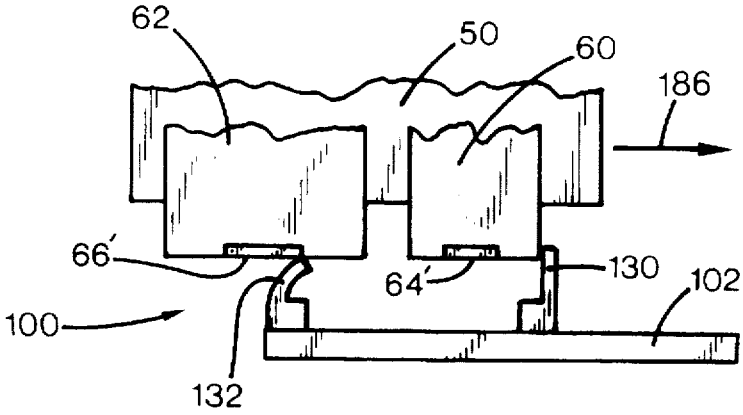
Figure 8:
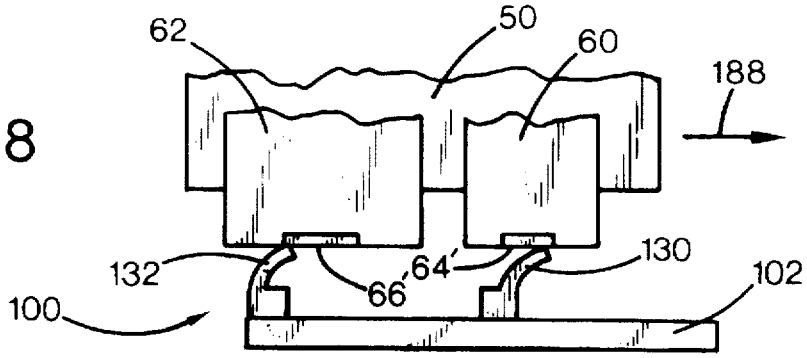

In FIG. 7, the color orifice plate 66' is just beginning to be wiped by the wiper 132, well before the black wiper 130 is even near the black orifice plate 64'. The second wipe of the color pen 60 is preferably done at the same speed as the first wipe in FIG. 6, here about 30.48 cm/sec. (12.0 inches per second), although it is apparent that different wiping speeds may be used for each pass. As the carriage 50 continues to move the pens in the second direction, indicated by arrow 188 in FIG. 8, the color wiper 132 finishes wiping the color orifice plate 66' as the black wiper 130 begins wiping the black orifice plate 64'. In transitioning between wiping the color and black orifice plates (FIG. 7 to FIG. 8), the carriage 50 slows to the preferred black orifice plate wiping speed of about 7.62 cm/sec. (3.0 inches per second), although different speeds may be selected for the first and second wiping passes.

Figure 9:
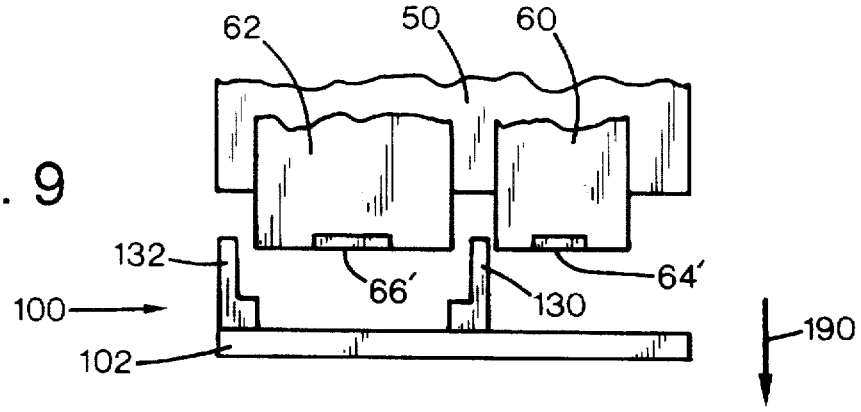

FIG. 9 shows the end of the second wiping pass of the preferred bi-directional wiping stroke. Both wipers 130, 132 are now free of the pens 60, 62, and the motor 170 then lowers the sled 102, as indicated by arrow 190, to the rest position elevation shown in FIG. 4. From there, the carriage 50 may transport the pens 60, 62 to the printzone 25 for printing, or to other regions of the service station for further servicing.

While the concepts of this adaptive wiping scheme have been described with respect to the illustrated hardware of service station 70, it is apparent that other service station designs may be similarly modified to provide these unique features. For instance, it is apparent that only relative motion between the orifice plates and the wipers is required to accomplish this multi-speed, single slew wiping stroke. For instance, while the illustrated embodiment moves the printheads past stationary wipers, other implementations of this wiping scheme may move the wipers past stationary printheads, or both the wipers and printheads may be moving during the wiping sequence.

Conclusion

Advantageously, the adaptive wiping system 100 removes the wiping constraints of one pen so they no longer hinder or inhibit optimum servicing of the other pen. Thus, each pen may be individually serviced in an optimum fashion to accommodate its unique servicing needs. This wiping system 100 allows the development of an optimum servicing routine for different types of pens. These concepts may be readily adapted to other multiple cartridge inkjet printing devices, of instance, one having three separate color cartridges, and perhaps a fourth black cartridge, by offsetting the locations of the individual wipers so only one (or some but not all) of the orifice plates are wiped during a portion of the wiping stroke, while the other wiper(s) are restrained from wiping until another portion of the wiping stroke.

This adaptive wiping system 100 advantageously provides a multi-speed wiping stroke that wipes both pens 60, 62 in a single wiping direction, that is, in a single "slew" or pass of the carriage 50 over the service station 70. Thus, the servicing sequence may be performed faster by accomplishing wiping of both pens in a single pass, which allows the printer 20 to devote more time to printing instead of servicing. The more time devoted to printing, the higher the throughput rating (measured in pages per minute) the printing device will receive, which equates to a faster printing speed that is desirable to most consumers.

We claim:

1. A method of cleaning first and second orifice plates of respective first and second inkjet printheads in an inkjet printing mechanism, comprising the steps of:

first wiping the first orifice plate with a first wiper at a first speed; and second wiping the second orifice plate with a second wiper at a second speed different from the first speed.

2. A method according to claim 1 wherein:

the first wiping step comprises the step of wiping in a first direction; and the second wiping step comprises the step of wiping in a second direction opposite the first direction.

3. A method according to claim 2, further including the steps of:

third wiping the second orifice plate with the second wiper at a third speed; and fourth wiping the first orifice plate with the first wiper at a fourth speed.

4. A method according to claim 3 wherein:

in the third wiping step, the third speed is substantially the same as the second speed; and in the fourth wiping step, the fourth speed is substantially the same as the first speed.

5. A method according to claim 1 wherein the first and second wiping steps comprise moving the first and second wipers simultaneously into a wiping position for subsequent wiping engagement with the first and second orifice plates.

6. A method according to claim 5, wherein the first and second wiping steps comprise moving the first and second orifice plates past the first and second wipers when in the wiping position.

7. A method according to claim 6 wherein the step of moving the first and second orifice plates comprises the steps of first moving the first and second orifice plates in a first direction past the first and second wipers, and then moving the first and second orifice plates past the first and second wipers in a second direction opposite the first direction.

8. A method according to claim 1 wherein:

the first wiping step comprises moving the first orifice plate past a stationarily held first wiper; and the second wiping step comprises moving the second orifice plate past a stationarily held second wiper.

9. A method according to claim 8 further including the step of supporting the first wiper and the second wiper on a single support member.

10. A method according to claim 1 wherein:

the first wiping step comprises refraining from contacting the second orifice plate with the second wiper; and the second wiping step comprises refraining from contacting the first orifice plate with the first wiper.

11. A wiping apparatus for cleaning first and second orifice plates of respective first and second inkjet printheads installed in an inkjet printing mechanism having a frame, comprising:

first and second upright wiper blades; and a support structure that joins the first and second wiper blades to the printing mechanism frame for movement between a rest position and a servicing position;

wherein the first wiper blade is supported by the support structure so when in the servicing position, the first wiper blade contacts the first orifice plate for wiping through a first relative movement of the first printhead and the first wiper blade, without the second wiper blade contacting the second orifice plate; and wherein the second wiper blade is supported by the support structure so when in the servicing position, the second wiper blade contacts the second orifice plate for wiping through a second relative movement of the second printhead and second wiper blade, without the first wiper blade contacting the first orifice plate.

12. A wiping apparatus according to claim 11, wherein:

the first relative movement of the first printhead and the first wiper blade comprises moving the first printhead with respect to the first wiper blade; and the second relative movement of the second printhead and second wiper blade comprises moving the second printhead with respect to the second wiper blade.

13. A wiping apparatus according to claim 11, wherein:

the first relative movement of the first printhead and the first wiper blade comprises relative movement at a first speed; and the second relative movement of the second printhead and second wiper blade comprises relative movement at a second speed different from the first speed.

14. A wiping apparatus according to claim 11, wherein:

the first relative movement of the first printhead and the first wiper blade comprises two segments of relative movement, with a first segment of relative movement being in a first direction, and a second segment of relative movement being in a second direction opposite the first direction; and the second relative movement of the second printhead and second wiper blade comprises two segments of relative movement, with a first segment of relative movement being in the first direction, and a second segment of relative movement being in the second direction.

15. A wiping apparatus for cleaning first and second orifice plates of respective first and second inkjet printheads installed in an inkjet printing mechanism having a frame, comprising:

first and second upright wiper blades; and a support structure that joins the first and second wiper blades to the printing mechanism frame for movement between a rest position and a servicing position;

wherein the first wiper blade is supported by the support structure so when in the servicing position, the first wiper blade contacts the first orifice plate for wiping through a first relative movement of the first printhead and the first wiper blade, without the second wiper blade contacting the second orifice plate; and wherein the second wiper blade is supported by the support structure so when in the servicing position, the second wiper blade contacts the second orifice plate for wiping through a second relative movement of the second printhead and second wiper blade, without the first wiper blade contacting the first orifice plate;

wherein the first relative movement of the first printhead and the first wiper blade comprises two segments of relative movement, with a first segment of relative movement being in a first direction, and a second segment of relative movement being in a second direction opposite the first direction;

wherein the second relative movement of the second printhead and second wiper blade comprises two segments of relative movement, with a first segment of relative movement being in the first direction, and a second segment of relative movement being in the second direction;

wherein the first segment of the first relative movement of the first printhead and the first wiper blade comprises relative movement at a first speed;

wherein the first segment of the first relative movement of the second printhead and the second wiper blade comprises relative movement at a second speed;

wherein the second segment of the second relative movement of the second printhead and second wiper blade comprises relative movement at a third speed; and wherein the second segment of the first relative movement of the first printhead and the first wiper blade comprises relative movement at a fourth speed.

16. A wiping apparatus according to claim 15, wherein:

the first speed of the first relative movement of the first printhead is substantially equal to the fourth speed; and the second speed of the second relative movement of the second printhead is substantially equal to the third speed.

17. A method of cleaning first and second orifice plates of respective first and second inkjet printheads installed in an inkjet printing mechanism, comprising the steps of:

first positioning the first orifice plate and a first wiper blade into mutual engagement;

after the first positioning step, first wiping the first orifice plate with the first wiper blade through relative movement of the first printhead and the first wiper blade;

second positioning the second orifice plate and a second wiper blade into mutual engagement;

after the second positioning step, second wiping the second orifice plate with the second wiper blade through relative movement of the second printhead and the second wiper blade;

during the first wiping step, refraining from contacting the second orifice plate with the second wiper blade; and during the second wiping step, refraining from contacting the first orifice plate with the first wiper blade.

18. A method according to claim 17 wherein:

the first wiping step comprises wiping the first orifice plate at a first speed; and the second wiping step comprises wiping the second orifice plate at a second speed different from the first speed.

19. A method of cleaning first and second orifice plates of respective first and second inkjet printheads installed in an inkjet printing mechanism, comprising the steps of:

first positioning the first orifice plate and a first wiper blade into mutual engagement;

after the first positioning step, first wiping the first orifice plate with the first wiper blade through relative movement of the first printhead and the first wiper blade;

second positioning the second orifice plate and a second wiper blade into mutual engagement;

after the second positioning step, second wiping the second orifice plate with the second wiper blade through relative movement of the second printhead and the second wiper blade;

during the first wiping step, refraining from contacting the second orifice plate with the second wiper blade;

during the second wing step, refraining from contacting the first orifice plate with the first wiper blade;

wherein the first wiping step comprises wiping the first orifice plate at a first speed;

wherein the second wiping step comprises wiping the second orifice plate at a second speed different from the first speed;

third wiping the second orifice plate with the second wiper at a third speed; and fourth wiping the first orifice plate with the first wiper at a fourth speed.

20. A method according to claim 19 wherein:

in the third wiping step, the third speed is substantially the same as the second speed; and in the fourth wiping step, the fourth speed is substantially the same as the first speed.

21. A method according to claim 19 wherein:

the first and third wiping steps each comprise the step of wiping in a first direction; and the second and fourth wiping step each comprise the step of wiping in a second direction opposite the first direction.

* * * * *